United States Patent [19]

Pukkila

[11] Patent Number: 4,540,338

[45] Date of Patent: Sep. 10, 1985

[54] SUCTION CHAMBER IN A FAN

[75] Inventor: Olli J. Pukkila, Helsinki, Finland

[73] Assignee: Oy Nokia AB, Helsinki, Finland

[21] Appl. No.: 481,158

[22] Filed: Apr. 1, 1983

[30] Foreign Application Priority Data

Apr. 5, 1982 [FI] Finland ..... 821186

[51] Int. Cl.[3] ..... F01D 25/24

[52] U.S. Cl. ..... 415/219 C; 415/185

[58] Field of Search ..... 415/219 C, 182, 183, 415/184, 185

[56] References Cited

U.S. PATENT DOCUMENTS

| | | | |
|---|---|---|---|
| 1,720,863 | 7/1929 | Stebbins | 415/219 C |
| 1,908,427 | 5/1933 | Jennings | 415/219 C |
| 1,955,250 | 4/1934 | Ogden | 415/219 C |
| 2,188,547 | 1/1940 | Anderson | 415/219 C |
| 2,228,207 | 1/1941 | Forssell | 415/198.1 |
| 3,018,650 | 1/1962 | Schmidt | 415/219 C |

FOREIGN PATENT DOCUMENTS

| | | | |
|---|---|---|---|
| 168357 | 5/1951 | Austria | 415/219 C |
| 2524556 | 12/1975 | Fed. Rep. of Germany . | |
| 3024224 | 1/1982 | Fed. Rep. of Germany . | |
| 311207 | 6/1969 | Sweden . | |
| 1230126 | 4/1971 | United Kingdom . | |

*Primary Examiner*—Robert E. Garrett
*Assistant Examiner*—John Kwon
*Attorney, Agent, or Firm*—Pennie & Edmonds

[57] ABSTRACT

This invention relates to a fan suction chamber having front, back, and bottom walls. The front wall defines a suction inlet; and the back wall has an upper section, which is parallel to the front wall, and a lower section, which slants downward and forward toward the front wall of the suction chamber at an angle of 67° to 78° with the horizontal. The bottom wall of the suction chamber connects the front wall and the lower section of the back wall. The depth of the chamber at the upper section of the back wall is 0.35 to 0.38 times the width of the suction chamber, and the depth of the chamber at a lower end of the lower section of the back wall is 0.14 to 0.18 times the width of the suction chamber. The diameter of the suction inlet is 0.42 to 0.50 times the width of the suction chamber.

3 Claims, 4 Drawing Figures

SUCTION CHAMBER IN A FAN

BACKGROUND OF THE INVENTION

1. Field of the Invention

This invention relates to a fan suction chamber having a front wall defining a suction inlet and a back wall having upper and lower sections. The upper section of the back wall is parallel to the front wall, and the lower section of the back wall slants downward and forward, toward the front wall of the suction chamber.

2. Description of the Prior Art

In fans it is sometimes necessary, owing to shortage of space, cost of making conduits, etc., to connect an air or gas conduit to the suction inlet of a fan in a direction which is perpendicular to the axis of the fan. If the conduit is connected to the suction inlet by means of a pipe bend, the bulk of the air will flow along the outer wall of the bend, whereby the impeller is loaded asymmetrically. In this case the fan will not achieve the pressure and the volume flow according to the calibration values, and its efficiency is also crucially lowered. In certain cases the measured increase in power consumption has been up to 60%.

Attempts have been made to eliminate this disadvantage by developing suction chambers for fans. It is virtually necessary to use a suction chamber in two-inlet fans, in which air flows via two suction chambers and two suction cones to two impellers, which suck in air from opposite directions, and further into one mutual casing. Such fans are used mainly when the volume flow is so great that two single-inlet fans would be needed.

There are power losses even in a suction chamber, and attempts have been made to eliminate them by making the chamber conical. Furthermore, attempts have been made to reduce power losses by placing a baffle plate or guide vanes in the chamber.

Even in these relatively complicated suction chamber structures, which are difficult to manufacture, the power loss is 4–10% of the total power consumption of the fan within the conventional operating range, depending on the manufacturer, the fan type, and the location of the operating point on the performance curve. Since suction chambers are used most in large fans, the power losses in question are considerable.

SUMMARY OF THE INVENTION

The present invention provides a suction chamber which comprises a rectangular front wall having a suction inlet and having a width defining the width of the chamber, and an opposite, back wall spaced a distance from said front wall. The back wall includes an upper section that is parallel with said front wall and a lower section that slants downward and forward, towards the front wall. The chamber may further include two side walls, a top wall, and a bottom wall. The side walls connect both sides of the front and back walls, the top wall connects the tops of the front and back walls, and the bottom wall connects the bottoms of the front and back walls. The top wall defines the depth of the chamber at the upper section of the back wall, and the bottom wall defines the depth of the chamber at a lower end of the lower section of the back wall. The corners of the suction chamber are angular without rounding or beveling, the depth of the chamber at the upper section of the back wall is 0.35 to 0.38 times the width of the chamber, and the depth of the chamber at a lower end of the lower section of the back wall is 0.14 to 0.18 times the width of the chamber. of the suction inlet of the back wall is 0.42 to 0.50 times the width of the chamber, and the lower section of the opposite wall defines an angle of 67° to 78° with the horizontal.

With this construction, the drawbacks of known suction chambers, as described above, have been largely eliminated. In the present invention, the power loss of the suction chamber is only 0.5–2.5% of the nominal power, depending on the fan type and the location of the operating point on the performance curve. The manufacturing cost of the suction chamber according to the invention is considerably lower than the manufacturing cost of known suction chambers, which are more difficult to manufacture. It is not necessary to round or bevel the corners, nor is it necessary to place baffles or guide vanes in the chamber. In spite of this, the power loss is considerably less than in known suction chambers.

One embodiment of the invention is described below with reference to the accompanying drawing.

DESCRIPTION OF THE PREFERRED EMBODIMENT

Figure 1:
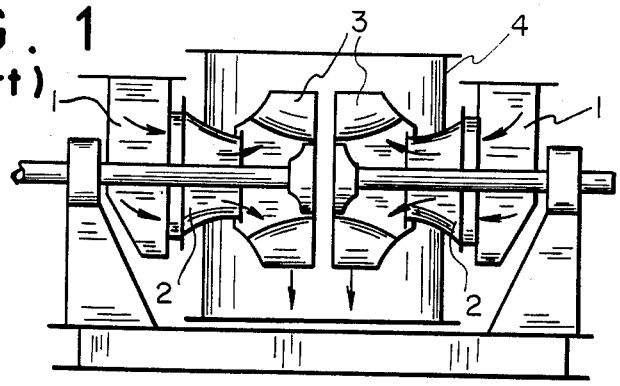
FIG. 1 (Prior Art)
FIG. 1 shows a known two-inlet fan with its suction chambers.

In the known two-inlet fan according to FIG. 1, air flows via two suction chambers 1 and two suction cones 2 to two impellers 3 sucking in air from opposite directions, and further into one mutual casing 4.

Figure 2:
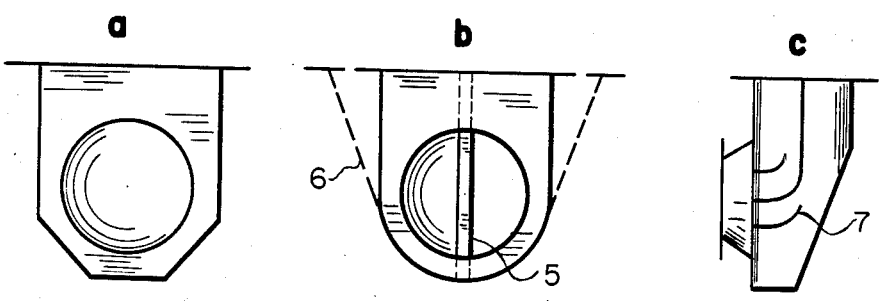
FIG. 2 (Prior Art)
FIG. 2*a–c* depicts known suction chamber structures.

FIG. 2 depicts known basic models of suction chambers. FIG. 2*a* shows, as seen from the suction-inlet side, a chamber with a beveled lower section. FIG. 2*b* shows respectively a chamber the lower section of which is rounded and in which a baffle 5 has been placed. In FIG. 2*b* there is, in addition, a conical structure indicated by dotted lines 6. FIG. 2*c* shows a side view of a suction chamber provided with guide vanes 7.

Figure 3:
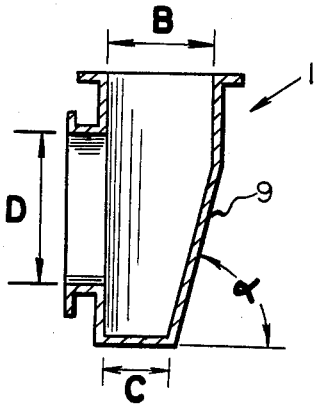
FIG. 3 depicts a side view of a suction chamber according to the invention.
Figure 4:
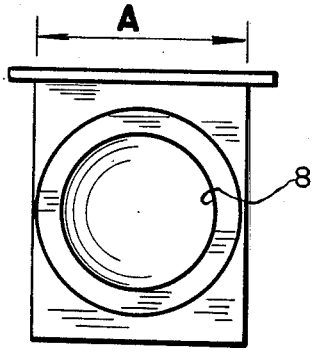
FIG. 4 shows the suction chamber of FIG. 3 as seen from the suction-inlet side, but with the connecting part left out.

In the embodiment according to the invention shown in FIGS. 3 and 4, A indicates the width of the suction chamber 1, B the depth of the chamber at the upper section of the back wall, C its bottom wall, and D the diameter of the suction inlet. The slanted lower section 9 of the wall opposite the suction inlet 8 is about $\frac{2}{3}$ of the height of this wall. The angle formed by the lower section and the horizontal plane is indicated by $\alpha$.

Depending on the fan type and the position of the operating point on the performance curve, A, B, C and D must, according to the invention, be as follows in proportion to A:

$B=0.35\text{–}0.38\times A$ $C=0.14\text{–}0.18\times A$ $D=0.42\text{–}0.50\times A$ Furthermore, the angle $\alpha$ must be 67°–78°. In this case the suction chamber can be made angular, without rounding or beveling, by selecting a suitable length for it, so that the wall which contains the suction inlet 8 is rectangular, whereby a high efficiency is achieved, the power loss being only 0.5–2.5% of the nominal power.

The suction chamber shown in the drawing is intended for use in connection with centrifugal fans, but the suction chamber according to the invention can also be used in connection with other fans.

What is claimed is:

1. In a fan, a suction chamber, which comprises:

(a) a rectangular front wall having (i) a suction inlet therein, and (ii) a width defining the width of the suction chamber;

(b) a back wall spaced from said front wall and including:

(i) an upper section parallel with said front wall, and (ii) a lower section slanting downwardly towards the front wall;

(c) two side walls connecting sides of the front and back walls;

(d) a top wall connecting the tops of the front and back walls, and defining the depth of the chamber at the upper section of the back wall;

(e) a bottom wall connecting the bottoms of the front and back walls and defining the depth of the chamber at a lower end of the lower section of the back wall;

(f) the corners of the suction chamber being angular without rounding or beveling;

(g) the depth of the chamber at the upper section of the back wall being 0.35 to 0.38 times the width of the chamber;

(h) the depth of the chamber at the lower end of the lower section of the back wall being 0.14 to 0.18 times the width of the chamber;

(i) the diameter of the suction inlet being 0.42 to 0.50 times the width of the chamber; and (j) the lower section of the back wall defining an angle of 67° to 78° C. with the horizontal.

2. A suction chamber according to claim 1 wherein the height of the lower section of the back wall is approximately two-thirds the height of the back wall.

3. A suction chamber according to claim 1 wherein the top wall contains an air inlet to said suction chamber.

* * * * *